US007507314B2

(12) United States Patent
Kirvesmäki et al.

(10) Patent No.: US 7,507,314 B2
(45) Date of Patent: Mar. 24, 2009

(54) VANE INTENDED FOR A HEADBOX OF A PAPER MACHINE AND METHOD FOR ENSURING THE STRAIGHTNESS OF A VANE

(75) Inventors: Jarmo Kirvesmäki, Jyväskylä (FI); Janne Lappi, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 389 days.

(21) Appl. No.: 10/598,417

(22) PCT Filed: Feb. 22, 2005

(86) PCT No.: PCT/FI2005/050042

§ 371 (c)(1),
(2), (4) Date: Aug. 29, 2006

(87) PCT Pub. No.: WO2005/085520

PCT Pub. Date: Sep. 15, 2005

(65) Prior Publication Data

US 2007/0163740 A1 Jul. 19, 2007

(30) Foreign Application Priority Data

Mar. 3, 2004 (FI) ..... 20040337

(51) Int. Cl.
*D21F 1/02* (2006.01)

(52) U.S. Cl. ..... 162/343; 162/199

(58) Field of Classification Search ..... 162/199, 162/212, 216, 336, 343, 344; 53/432–434
See application file for complete search history.

(56) References Cited

U.S. PATENT DOCUMENTS

| | | | | |
|---|---|---|---|---|
| 5,806,283 | A * | 9/1998 | Shafer | 53/434 |
| 6,521,095 | B1 * | 2/2003 | Bonander | 162/343 |
| 2002/0043355 | A1 * | 4/2002 | Ruf et al. | 162/216 |
| 2003/0131964 | A1 * | 7/2003 | Erikson et al. | 162/343 |

FOREIGN PATENT DOCUMENTS

| | | | |
|---|---|---|---|
| DE | 4140097 | A1 | 6/1993 |
| WO | WO 01/98582 | * | 12/2001 |
| WO | 2005/085520 | A1 | 9/2005 |

OTHER PUBLICATIONS

Headbox Flow Sheet Comparison—Part 1 of 2, Metso Paper, Feb. 7, 2007 [http://www.metsopaper.com/paper/MPwUpRunning.nsf].*
Headbox Flow Sheet Comparison—Part 2 of 2, Metso Paper, Feb. 14, 2007 [http://www.metsopaper.com/paper/MPwUpRunning.nsf].*
International Search Report issued in PCT/FI2005/050042.

* cited by examiner

*Primary Examiner*—Eric Hug
(74) *Attorney, Agent, or Firm*—Stiennon & Stiennon

(57) ABSTRACT

A vane intended for a headbox of a paper machine or equivalent is moistened and enclosed in a vapor-proof package to ensure the straightness of the vane. At least a portion of the vane is made of a water-absorbing material, such as plastic or a composite. Advantageously, the vane contains moisture in an amount that corresponds to the equilibrium moisture content of the vane in headbox conditions. It is enclosed in a package, preferably a vacuum package, which retains the moisture of the vane until the vane is put into use.

13 Claims, No Drawings

VANE INTENDED FOR A HEADBOX OF A PAPER MACHINE AND METHOD FOR ENSURING THE STRAIGHTNESS OF A VANE

CROSS REFERENCES TO RELATED APPLICATIONS

This application is a U.S. national stage application of international app. No. PCT/FI2005/050042, filed Feb. 22, 2005, the disclosure of which is incorporated by reference herein, and claims priority on Finnish App. No. 20040337, filed Mar. 3, 2004.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a vane intended for a headbox of a paper machine or equivalent. The invention also relates to a method for ensuring the straightness of a vane intended for a headbox.

By the paper machine or equivalent is meant paper, board and soft tissue machines.

Vanes are used in the slice channel of the headbox for damping large-scale turbulence and for converting it into small-scale turbulence to thereby prevent the formation of fiber bundles and improve the quality of the paper to be manufactured. Vanes are also used in multi-layer headboxes for separating the different layers of flow from one another.

Vanes can be manufactured of metal, plastic or a composite composed of a binder and fibers embedded in the binder. They can be of equal thickness in cross-section or thinning in a wedge-like manner towards a trailing edge. The vanes are attached by their leading edge, as viewed in the flow direction, to an attachment groove provided in the turbulence generator of the headbox, so that their trailing edge is able to float freely with the flow in the slice channel of the headbox. Between the vanes there are tapering flow channels, in which the velocity of the pulp suspension accelerates towards the slice opening of the headbox. With respect to the uniformity and undisturbed state of the flow discharging out of the slice opening it is essential that the vanes placed in the slice channel of the headbox are straight and parallel.

It has been found that a vane made of plastic or a composite absorbs some water in the moisture and temperature conditions of the headbox, so that the dimensions of the vane may change as a result of swelling. When a new wedge-shaped vane is fitted in the headbox, its thin trailing edge reaches an equilibrium moisture content much more quickly than the thick leading edge. This readily leads to the fact that the vane warps and undulation is produced in it, which adversely affects the quality of the paper being manufactured.

The temperature and moisture conditions during the manufacture, transport and storage of vanes are generally different from the operating conditions in the headbox. Vanes intended for the headbox have to be stored in varying conditions for varying periods of time before they are put into use. For the reasons set out above, vanes whose moisture content is different from the equilibrium moisture content of the vane during use in the headbox must be fitted in the paper machine. It may take several weeks to reach a state of equilibrium when vanes are put into use, and during that time the quality of paper readily suffers from the uneven shape of the vanes.

SUMMARY OF THE INVENTION

An object of the invention is to reduce the problems associated with the putting into use of a vane. In particular, it is an object to ensure that the vane retains its shape during storage and is ready for use immediately after it is fitted in a paper machine.

BRIEF DESCRIPTION OF THE DRAWINGS

Not applicable.

DESCRIPTION OF THE PREFERRED EMBODIMENTS

To ensure the straightness of the vane, the vane is moistened, preferably already in connection with manufacture, and enclosed in a vapor-proof package. The vane is treated so that it contains moisture in an amount that corresponds to the equilibrium moisture content of the vane in headbox conditions. The vane is enclosed in a package that retains the moisture of the vane until it is put into use. The package is preferably a vacuum package.

The length of the vane intended for the headbox generally corresponds to the width of the headbox, which may be, at its widest, as much as 11 m. The thickness of the leading edge of the wedge-shaped vane can be about 10 mm, while the thickness of its trailing edge is only about 0.5 mm. When the thin trailing edge absorbs moisture more quickly than the thick leading edge, stresses are readily produced in the vane, which causes deformations. This phenomenon can be avoided by moistening the vane in advance to a desired moisture content and by maintaining the vane moist. In tests it has been found that the change in the length of the vane as a result of moistening is of the order of 1.5 mm/m. Moistening increased the weight of the vane by about 1.5%.

Moistened vanes packed in a vapor-proof manner remain straight during the time of storage and are immediately ready for use when taken out of the package. The invention enables water-absorbing materials to be used as a raw material for vanes.

The method for ensuring the straightness of vanes according to the invention is advantageous when considering the total costs of the vanes, possible technical arrangements to compensate for warping, and the benefits achieved in the behavior of the vane, in particular when it is put into use.

The vanes can be manufactured in the usual manner, for instance, of plastic or of a composite material, after which they are impregnated with steam. The treatment can be accomplished, for example, using a steam chamber where vanes are stored for several weeks. The steam treatment can last, for example, 4-5 weeks at a temperature of 60-70° C. The lower the temperature at which moistening is carried out, the longer the time needed for reaching the desired moisture level.

Alternatively, moistening can be accomplished by immersing vanes in hot water, for example, of 60-70° C., for a sufficiently long period of time.

After the steam treatment, the vane is enclosed in a vapor-proof foil bag or in another equivalent package. The foil bag is provided with a vacuum and it is closed air-tightly. The closed package retains the moisture of the vane, whereby the vane remains straight. When the vacuum-packed vane is later put into use at a paper mill, an unbroken vacuum package indicates that the moisture content of the vane has remained the same as it was when the vane was packed in foil.

Advantageously, the vane is moistened immediately in connection with manufacture in the production plant which manufactures vanes, but there is nothing to prevent that the treatment is accomplished at some later stage.

Advantageously, the vane is made of a water-absorbing material, but there is nothing to hinder that the treatment is performed on vanes made of another material or of a combination of several materials.

Many variations of the invention are feasible within the scope defined in the claims presented next.

The invention claimed is:

1. A method for ensuring the straightness of a vane for a headbox of a paper machine comprising the steps of:

moistening the vane to a selected moisture content followed by;

enclosing the moistened vane in a vapor-proof package.

2. The method of claim 1, further comprising the step of manufacturing at least part of the vane of a water-absorbing material.

3. The method of claim 1, further comprising the step of manufacturing at least part of the vane of a water-absorbing plastic material.

4. The method of claim 1, further comprising the step of manufacturing at least part of the vane of a water-absorbing, composite material.

5. The method of claim 1, wherein the selected moisture content corresponds to the vane equilibrium moisture content in headbox conditions.

6. The method of claim 1, further comprising the step of keeping the vane in the package until the vane is put into use.

7. The method of claim 1, wherein the step of enclosing the moistened vane in the vapor-proof package includes drawing and retaining a vacuum in the package.

8. The method of claim 1, wherein the step of moistening the vane is preformed in connection with a step of manufacturing the vane.

9. The method of claim 1, wherein the step of moistening comprises keeping the vane in a steam atmosphere until the vane's moisture content reaches the selected moisture content.

10. The method of claim 1 wherein the step of moistening the vane comprises keeping the vane in a hot water bath until the vane's selected moisture content is reached.

11. A method for ensuring the straightness of a vane for a headbox of a paper machine comprising the steps of:

manufacturing the vane at least in part of a water-absorbing material;

moistening the vane to a selected moisture content followed by;

enclosing the moistened vane in a vapor-proof package;

providing a vacuum to the vapor-proof package and closing the package air-tightly;

transporting the vane in the package while retaining the selected moisture content; and before using the vane checking to see if the vacuum package remains unbroken, and if the vacuum package remains unbroken installing the vane in a headbox.

12. The method of claim 11 wherein the step of moistening the vane to a selected moisture content is preformed by storing the vane in a steam chamber where the vane is subjected to steam until the selected moisture content is reached.

13. The method of claim 11 where in the step of moistening the vane to a selected moisture content is preformed by immersing the vane in water of a selected temperature until the selected moisture content is reached.

* * * * *